United States Patent [19]

Murch

[11] 4,005,890

[45] Feb. 1, 1977

[54] DOOR LOCK STRIKE GUARD

[75] Inventor: Robert F. Murch, Woodside, Calif.

[73] Assignee: Schlage Lock Company, San Francisco, Calif.

[22] Filed: Oct. 15, 1975

[21] Appl. No.: 622,738

Related U.S. Application Data

[63] Continuation of Ser. No. 495,851, Aug. 8, 1974, abandoned.

[52] U.S. Cl. ..... 292/346; 292/340

[51] Int. Cl.[2] ..... E05C 21/00

[58] Field of Search ..... 292/346, 340, 1; 70/416, 418

[56] References Cited

UNITED STATES PATENTS

| | | | |
|---|---|---|---|
| 1,314,336 | 8/1919 | Kemp | 292/340 |
| 1,377,458 | 5/1921 | Block | 292/340 |
| 1,599,256 | 9/1926 | Vichweger | 292/340 X |
| 1,853,456 | 4/1932 | Ross | 292/346 |
| 2,041,625 | 5/1936 | Schmidt | 292/346 X |
| 2,964,346 | 12/1960 | Check | 292/340 |
| 3,095,021 | 6/1963 | Schlage et al. | 292/340 X |
| 3,764,173 | 10/1973 | Griffith | 292/346 |
| 3,815,945 | 6/1974 | Lamphere | 292/340 |

FOREIGN PATENTS OR APPLICATIONS

| | | | |
|---|---|---|---|
| 594,692 | 11/1947 | United Kingdom | 292/346 |

*Primary Examiner*—Roy D. Frazier
*Assistant Examiner*—Rodney H. Bonck
*Attorney, Agent, or Firm*—Lothrop & West

[57] ABSTRACT

A door lock strike guard is for use with a door jamb having a strike pocket therein and overlying a frame member. The guard itself is a flat metal bar having at one end a panel adapted to be disposed at one side of the strike pocket and having at the other end a leg adapted to be driven into a bore in the frame member. Between the panel and the leg there is an offset strap so that the leg is well displaced from the edge of the frame member. A lateral force on the strike pocket wall, normally borne only by the part of the jamb bounding the strike pocket, is additionally borne by the panel and at least in part is transferred to the frame member. In a modification, a screw regulates the penetration of the leg into the bore.

1 Claim, 5 Drawing Figures

DOOR LOCK STRIKE GUARD

This is a continuation of application Ser. No. 495,851, filed Aug. 8, 1974 and now abandoned.

There is an increasing need for security in connection with building and dwelling lock sets and particularly such lock sets as applied to hinged doors for affording access to the interior of the structure. While the mechanical development of the bolt portion of the lock sets has proceeded with increasing strength and security, the cooperating portion of the lock set, the strike, has not been as well developed. In many instances it is possible for a person, simply by throwing his weight or by delivery of a kick against the door panel, to break the strike plate and its mountings away from the door jamb or frame. Access to the interior is thus gained without actuating or substantially disturbing the bolt portion of the lock set. There are millions of such installations readily warranting some additional deterrent toward entry and there are many new installations in which an increased degree of security on the strike side is desirable. The nature of building construction is reasonably well standardized throughout the country and in many other parts of the world whether the building materials are wood, metal or like materials and most all have the described vulnerability.

It is therefore an object of the invention to provide a door lock strike guard that can easily and readily and economically be installed by a relatively unskilled workman into lock sets presently in existence in order to afford additional resistance to door opening by lateral force.

Another object of the invention is to provide a door lock strike guard that can easily be incorporated in new installations as well as in older installations.

A further object of the invention is to provide a door lock strike guard that is compatible with various kinds, designs, styles and makes of lock sets currently in use.

Another object of this invention is to provide a door lock strike guard that materially strengthens the strike portion of a lock set.

A further object of the invention is to provide a door lock strike guard that can easily and readily be fabricated by machinery such as is customarily utilized for the manufacture of lock sets.

A further object of the invention is in general to provide an improved door lock strike guard to increase the door security, particularly on the strike or jamb side.

Other objects, together with the foregoing, are attained in the embodiment of the invention described in the accompanying description and illustrated in the accompanying drawings, in which.

Figure 1:
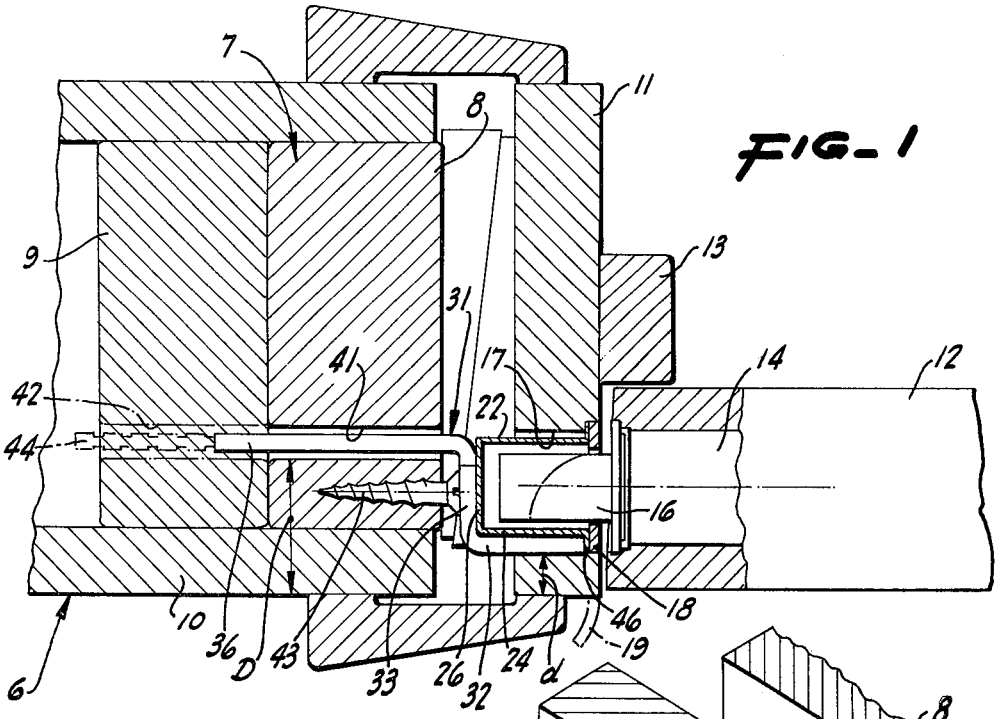
FIG. 1 is a cross-section on a horizontal plane showing the door lock strike guard as installed in a typical environment.

While the door lock strike guard pursuant to the invention is readily adaptable to many different kinds of building construction, particularly door framing and construction, it has with success been incorporated in a typical environment, as shown herein. In a representative surrounding there is customarily provided a wall 6 marking the division between a pair of rooms, for example, and including in its load-bearing construction a door frame 7 made up of a relatively short upright, wooden member 8, usually called a cripple, and an adjacent, relatively long, upright, wooden member 9, usually called a stud. In some instances these members are replaced by composite or metallic members. The precise material is not of great importance, although it is of importance that the cripple and the stud, used singly or together, are well tied in with the framing of the wall 6 and the rest of the building so that they themselves are relatively stable and are difficult to disturb or dislodge by any force that can normally be exerted. The members 8 and 9 are overlain by one or more wall sheets 10.

Disposed adjacent the cripple 8 in the wall 6 is a door jamb 11, the edges of which are about coplanar with the wall sheets 10. The jamb is part of the customary framing for a door panel 12 mounted to swing on hinges (not shown) and to occupy a closed position, as shown in FIG. 1, the closing motion being limited by a door stop 13 secured to the jamb 11. The door panel is intended to swing between the closed position shown and an open position spaced substantially from the stop 13. Within the door panel 12 there is mounted the customary lock bolt unit 14 of a lock set. The unit 14 includes a projecting dead bolt or latch bolt 16 designed to be withdrawn and projected in the customary fashion.

To accommodate the bolt 16, the jamb 11 is normally provided with a strike pocket 17 as the companion part of the lock set. The designation "pocket" is intended to include various different kinds of receivers for the projected bolt 16 and includes at least an opening in and often extending through the jamb 11. Because of wear it is customary to supplement the minimal pocket 17 by a strike plate 18 secured to the jamb 11 by screws 20 and sometimes recessed. For a latch bolt the strike plate usually has a curved entrance lip 19 and always has an opening 21 affording access for the bolt 16 to the strike pocket 17. In may installations the pocket is left untrimmed, but in other instances, and for a better construction, the pocket 17 is lined by a strike box 22 usually of thin metal often secured to the strike plate 18 and giving a finished appearance to the otherwise ragged strike pocket 17. The strike box 22 preferably includes a side wall 23, on the "closed" side of the opening, and a side wall 24, on the "open" side. In addition, there is a solid bottom 26.

The normal or standard installation is substantially as described. When the door panel 12 is in closed position substantially against the stop 13 and the bolt 16 is projected through the opening 21 in the strike plate 18, the bolt lies partially, at least, within the strike pocket 17 and within the strike box 22 when a box is provided. If sufficient lateral force is exerted on the door panel 12 in an opening direction away from the stop 13, some of the material of the door jamb 11, the strike plate 18 and the box 22 can be broken away from the remaining jamb. In many instances the dimension *d* between the open edge of the door jamb and the adjacent edge of the strike pocket 17 is relatively small. The jamb material usually is not particularly thick and may be of relatively weak wood. Under these circumstances an impact in an opening direction against the panel 12 can readily dislodge the material of the jamb adjacent the bolt and strike and the purpose of the lock set is defeated. This is true even though the bolt unit 14 of the lock set is highly resistant to tampering.

Figure 4:
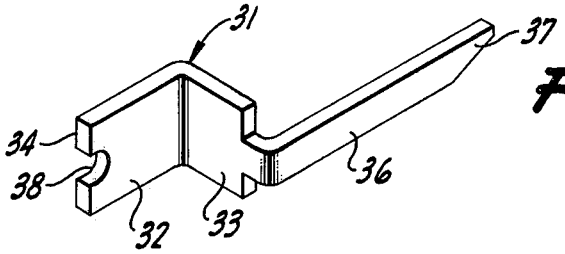
FIG. 4 is an isometric perspective of a door lock strike guard bar.

To prevent this type of unauthorized entry, I particularly afford a door lock strike guard. This may take a number of different forms but in the present instance has been incorporated in a way to increase the resistance to opening by improper means several fold over previous conditions. The guard itself (FIG. 4) is usually a flat-stock, metallic bar, generally designated 31. At one end the bar has a substantially rectangular panel 32 of approximately the same shape and extent as the opening side 24 of the strike box 22 or of the pocket 17. The transverse cross-section of the panel 32 is generally a vertically elongated, rectangular figure.

The panel 32 merges with or bends into a strap 33 likewise of generally rectangular configuration and disposed a predetermined distance from the outer end 34 of the bar. In turn, the strap 33 merges with or is bent into a leg 36 also of rectangular configuration in transverse cross-section. Either or both of the strap and the leg are somewhat less in height than the remaining part of the structure. The leg occupies a plane substantially parallel to but spaced from the plane of the panel 32. The leg 36 is relatively long and at its far or free end is reduced to afford a tapered point 37.

For convenience in initial installation, the panel 32 is interrupted along the end 34 to provide a nearly circular or semicircular indentation 38 to serve as a marking template.

Figure 3:
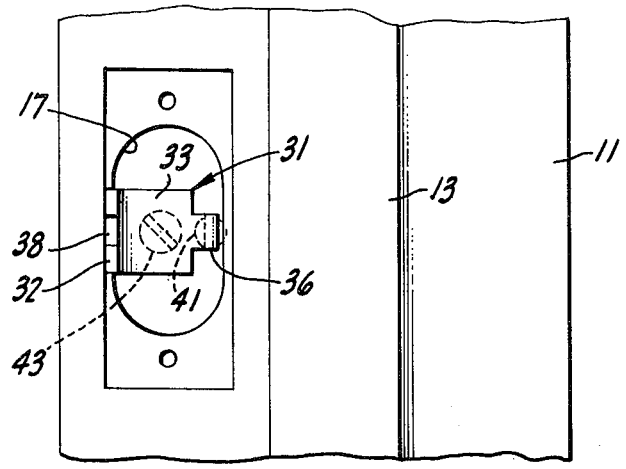
FIG. 3 is an elevation of a portion of a door jamb and related framing, the lock set strike plate and strike box being omitted.
Figure 5:
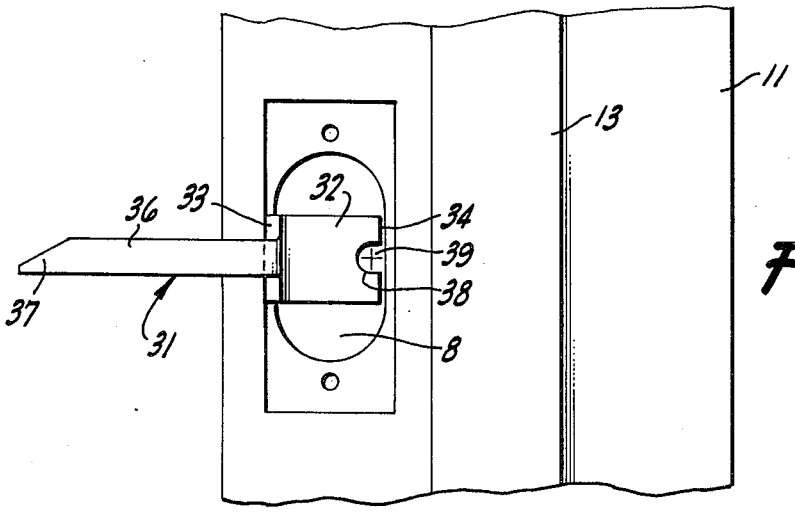
FIG. 5 is a view similar to FIG. 3 and showing the door lock strike guard positioned therein as a template.

In a new installation in which the door 12 is out of the way, the strike plate 18 has not yet been mounted and the strike box 22 is not positioned, the panel 32 of the bar 31 is first placed into the strike pocket in a template position, as shown in FIG. 5. In this position the indentation 38 overlies or substantially overlies the adjacent face of the cripple 8. A pencil or scribe mark 39 tracing the outline 38 or its center is then made on the cripple (see FIG. 5). The installer then utilizes a small drill or bit to provide in the cripple 8 a bore 41 (see FIG. 3) of circular configuration having a diameter no greater than the height of the leg 36 and preferably of a somewhat lesser or interfering dimension. The bore 41 can extend through the cripple 8 and can likewise extend, as shown by the dotted lines 42 (FIG. 1), into and even through the stud 9.

When the bore has been completed and the boring tool withdrawn, the bar 31 is installed by inserting the leg 36 extending horizontally but with its height vertically. The reduced point 37 enters into the bore 41. By means of a flat end punch or the like and a hammer and with the panel 32 substantially abutting and sliding on the opening side of the strike pocket 17, the installer forces the leg 36 into the bore 41, slightly displacing the cripple material. He does this until the end 34 is substantially flush with or slightly below the outer surface of the door jamb 11. In some instances the air gap or distance between the adjacent faces of the cripple 8 and of the door jamb 11 is just right so that the strap 33 abuts against the cripple surface when the end 34 is about or nearly flush with the exposed face of the door jamb.

In other instances when installing the jamb 11 there is left a random or variable gap or distance between the adjacent faces of the jamb and the cripple. Such distance may be too much to lodge the end 34 approximately flush with or slightly below the jamb exposed surface. In those instances a screw 43 (see FIG. 1) is driven into the cripple 8 just far enough so that the head of the screw serves as an abutment for the strap 33 and so gauging the end 34 at or close to the surface of the jamb 11. The aim is to back as much as possible of the vulnerable side of the strike pocket.

Depending upon the size of the parts used and the dimensions of the leg 36, it may be that the leg 36 extends from or beyond the surface of the cripple 8 or of the stud 9. In some localities it is customary to provide electrical wiring stapled onto the surface of the stud 9, for example. Where that is true it is desirable to avoid having the bore 41 in the vicinity of the wiring, but sometimes the wiring is laid over the bore 41. For that reason it is possible to insulate or dip the point 37 of the leg in an insulated material. Alternatively, the bar 31 can be made of a non-conducting material rather than of metal. Further, the length of the leg 36 can be limited, to make sure that it does not project, by having breakaway tip portions 44 (FIG. 1) that the installer can snap off upon installation. Again, in some instances the bar 31 is not made integrally of a single material but rather is a composite of various parts appropriately secured together, some of which are of insulating material.

Figure 2:
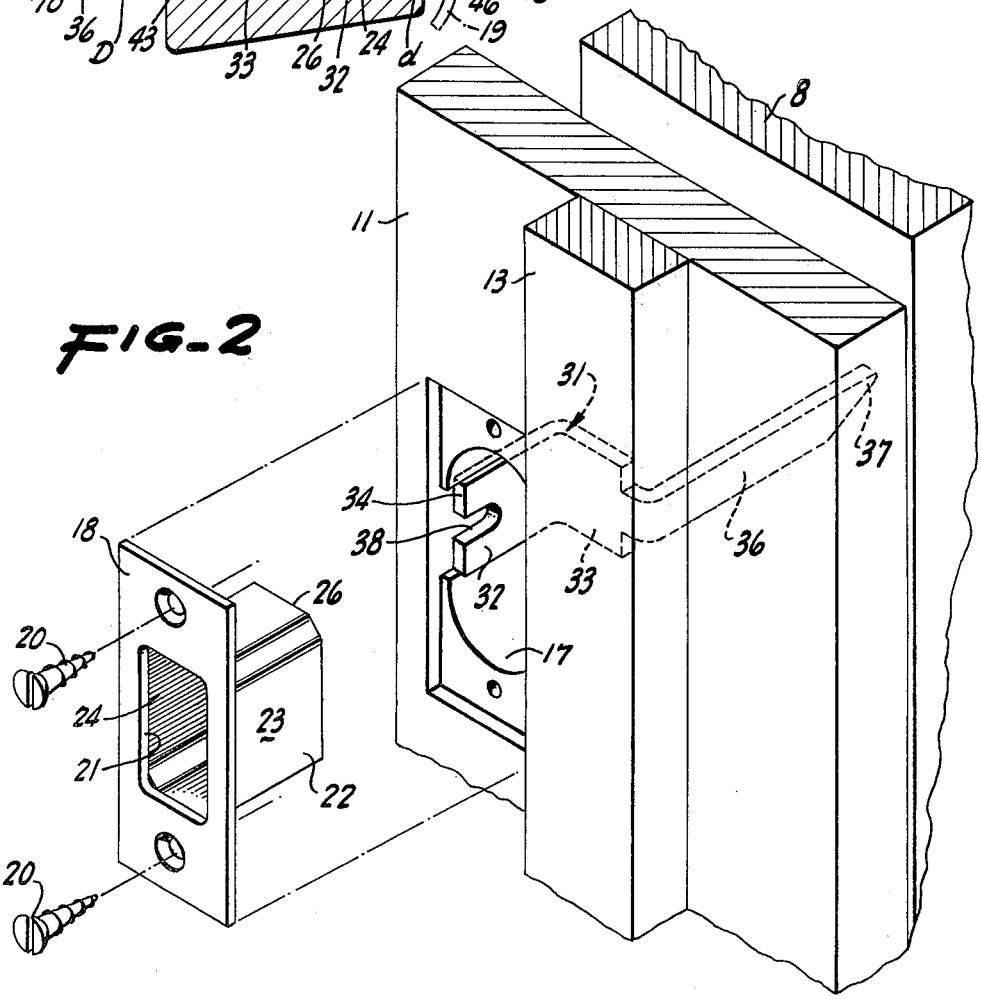
FIG. 2 is an exploded view in isometric perspective showing much of the same structure disclosed in FIG. 1.

In many instances the size of the strike pocket 17 is substantially larger than the size of the strike box 22. There is adequate room between the side wall of the pocket and the side wall of the box freely to receive the panel 32. In the event there is a tight fit, then some of the material of the jamb 11 is removed to afford space to accept the panel 32 (see FIG. 2).

In any installation the aim is to provide a relatively strong, immediate backing for the opening wall 24 of the strike box or a relatively strong abutment for the bolt 16, the backing being effective to transfer lateral loads away from the door jamb 11 and into the structural portions 7 and 8 of the building framing. If one then endeavors to open the door 12 by impact or excess force, the bolt 16 transfers such force to the panel 32 which in turn transfers much of the force through the strap 33 and into the leg 36 and so to the strong surroundings. The strap 33 abuts the cripple 8 either directly or through the screw 43 and is adequately supported. Under these circumstances the horizontal rotational moment or dislodging force transmitted by the bolt 16 is well resisted by the bar 32 and the substantial thickness of the cripple 8 and also, if used, of the stud 9.

One of the principal reasons for the offset provided by the strap 33 is to make sure that the distance D of the bore 41 from the opening face of the cripple 8 and from the wall sheet 10 is much greater than the predetermined distance *d* from the opening edge of the strike pocket to the jamb edge.

Old installations can be augmented by removing the existing strike plate, and box if used, and reinstalling them after following the new installation process for the bar 31. In some cases, the bar 31 need not be separate from the strike plate or from the strike box but alternatively can be united therewith by spot welding; for example, as indicated by the weld spots 46 in FIG. 1.

With this construction, numerous tests have demonstrated that, with the guard, the force required to dislodge the bolt 16 through the materials of the jamb and frame by breaking them away is many times the force required when the present guard is not employed. In fact, the required force is so great as to be more than can ordinarily be exerted by a person not using effective tools; that is, the door panel 12 cannot be kicked open or forced open by bodily impact. In this way the security of the lock set, particularly the strike portion of the lock set, is very materially increased and in an easily applied economical, long-lasting fashion.

What is claimed is:

1. In a door lock strike guard arrangement having a frame member and a door jamb adjacent and overlying the same to define an edge of a door opening; an opening through said jamb having a side thereof adjacent one edge of said jamb and defining a strike pocket facing said door opening; an elongated opening in said frame member generally parallel to said side of said pocket but spaced therefrom in a direction away from said one edge of said jamb and being aligned with a portion of said pocket; a strike guard comprising a unitary substantially rigid strike guard member having a panel portion lying adjacent said one side of said pocket, an offset portion substantially perpendicular to said panel portion at the edge thereof nearest said frame member and spaced from said frame member, and a leg portion generally parallel to said panel portion extending from said offset portion at the edge thereof farthest from said one edge into said elongated opening and interengaging said frame member with a force fit whereby any force applied to said panel portion in a direction toward said one edge of said jamb is transmitted to and resisted by said frame member, and including abutment means on said frame member engaging and buttressing said offset portion.

* * * * *